US006006646A

United States Patent [19]

Makris et al.

[11] Patent Number: 6,006,646

[45] Date of Patent: Dec. 28, 1999

[54] ANTI-PERSONNEL MINE FOOT PROTECTION SYSTEMS

[75] Inventors: Aristidis Makris, Nepean; Richard J. L'Abbé , Ottawa; Pierre Voisine, Limoges; Gad Shaanan, Westmount; Serge Dubeau, Montreal; Charles De Gagné , Montreal; Derek Hunziker, Montreal; Harald Hermann Kleine, Ottawa; Benoît Orban, St-Laurent, all of Canada

[73] Assignee: Med-Eng Systems Inc., Ottawa, Canada

[21] Appl. No.: 09/063,473

[22] Filed: Apr. 20, 1998

[30] Foreign Application Priority Data

Jul. 18, 1997 [CA] Canada ..... 2210868

[51] Int. Cl.[6] ..... F41H 5/08

[52] U.S. Cl. ..... 89/36.05; 36/7.5

[58] Field of Search ..... 36/7.5; 89/36.05

[56] References Cited

U.S. PATENT DOCUMENTS

| | | | |
|---|---|---|---|
| 2,205,073 | 6/1940 | Smit | 36/59 C |
| 2,720,714 | 10/1955 | Krohn et al. | 36/7.5 |
| 2,747,300 | 5/1956 | Field | 36/7.5 |
| 3,243,898 | 4/1966 | Lewis, Jr. et al. | 36/7.5 |
| 3,318,024 | 5/1967 | Fujinaka et al. | 36/85 |
| 3,516,181 | 6/1970 | Jordan | 36/7.5 |
| 5,867,922 | 2/1999 | Hull et al. | 36/7.5 |

OTHER PUBLICATIONS

Blast Protective Boot & Overboat Brochure—Ro—Search Inc.

*Primary Examiner*—Charles T. Jordan
*Assistant Examiner*—Jeffrey Howell
*Attorney, Agent, or Firm*—Merchant & Gould P.C.

[57] ABSTRACT

A system to provide foot protection against anti-personnel land mines is designed for use by mine clearance personnel and includes a raised frame having a central foot support location thereon which ensures a spacing of the wearer's foot above the ground surface of from 10 to 30 cm. The ground-engaging parts of the frame are spaced forwardly and rearwardly of the foot location and the frame includes on its underside blast protection material, the combined results of these measures being to greatly attenuate the blast and fragmentation effects of an exploding mine on the foot of the user. Moreover, the underside of the structure, including legs, is aerodynamically shaped to deflect the blast wave loading and fragments generated by the mine detonation.

25 Claims, 5 Drawing Sheets

ANTI-PERSONNEL MINE FOOT PROTECTION SYSTEMS

BACKGROUND OF THE INVENTION a) Field of the Invention

This invention relates to a new or improved system to provide foot protection against anti-personnel land mines. The invention is particularly intended for use by military specialists involved in mine clearance operations, although it is likewise suitable for use by other military and civilian personnel.

b) Description of the Prior Art

For many decades the laying of mine fields has been used by various military organizations both official and irregular to deny access or to inhibit movement of enemy personnel in selected locations. The mines are buried or otherwise camouflaged and are designed to explode when actuated by the presence of enemy personnel, being triggered by various means such as trip wires, pressure sensors, etc. Larger mines are deployed for the purpose of destroying or disabling trucks and tracked armoured vehicles, but these mines are in some respects of lesser concern since they are not likely to be triggered by an individual's stepping on them.

Well organized official national armies when deploying a mine field make a practice of preparing a map indicating the location of each mine that is laid, both for the safety of their own personnel, and also with a view to removing the mines after a conflict situation has been resolved. However other military organizations and especially guerillas too often do not prepare proper maps of the location of mines that have been deployed and make no effort whatever to retrieve previously laid mines. Such abandoned mines therefore remain in place constituting for many years a hazard to the lives of wild animals, livestock, and people residing in the vicinity. Every year thousands of people are accidentally killed or maimed by such abandoned anti-personnel mines, and furthermore the presence of mines denies people access to or utilization of large tracts of land.

The clearance of mine fields is extremely dangerous work and is dealt with by specially trained military personnel who are skilled in de-activation and removal or safe detonation of mines. However no level of skill can guarantee against accidental detonation of an antipersonnel mine which has not been detected or which is of a design that is unfamiliar to the mine disposal operative, and accordingly it is necessary to equip the operative with as much protective clothing as is possible without excessively restricting his freedom of movement. Thus it is usual to protect mine clearance operatives by providing clothing and padding which will absorb the blast forces and projectiles created by anti-personnel mines. Such equipment includes protective helmets and foot wear.

Experience has shown that the feet of operatives working on mine clearance are particularly vulnerable to injury, and various proposals have been brought forth to reduce such injuries. Examples of prior proposals for protective footwear are shown in U.S. Pat. No. 2,720,714 Krohn et al., U.S. Pat. No. 3,318,024 Fujinaka et al and U.S. Pat. No. 3,516,181 Jordan.

None of the prior proposals for protective footwear has been entirely satisfactory. Some proposals are too weighty and unwieldy while others do not provide a sufficient spacing of the feet of the operative above the ground in which a mine may be embedded, and still others do not provide sufficient stability for support of the operator. None of the prior protective footwear can avoid the possibility that the operative may tread on and thus detonate a mine located immediately underneath his foot.

SUMMARY OF THE INVENTION

The present invention provides a protection system to protect the foot of a user against anti-personnel mines and the like, said system comprising: a frame configured to receive and be attached to a user's foot to support the foot in a location that is at a height of at least about 10 cm above a ground surface; said frame carrying ground-engaging elements that have overall extents in longitudinal and lateral directions that are sufficient to provide stable support for said frame on a supporting ground surface; at least parts of said system being compliantly deformable to accommodate irregularities in the supporting ground surface. The system preferably also includes blast protecting material completely covering the underside of the foot location.

Preferably the ground engaging elements of the system are spaced forwardly and rearwardly relative to the foot location so that they will not cause detonation of an undetected mine that is immediately below the foot of the operative. The front ground-engaging elements are positioned between about 10 and 40 cm preferably between about 15 and 30 cm, and most preferably about 25 cm forwardly of the front of the foot location; the rear ground engaging elements are spaced to the rear of the foot location by similar amounts, and the front and rear ground-engaging elements are spaced apart longitudinally by at least about 20 cm, preferably between about 25 and 80 cm, and most preferably about 35 cm.

The ground engaging elements may comprise forward and rearward pairs of laterally spaced pods which can provide a stable support for the system even upon irregular ground surfaces.

The blast protecting material on the underside of the foot location preferably has an underside that tapers convexly towards a rounded lower end presenting a downwardly arched outer surface that will have a deflecting effect upon fragments which may be hurled upwardly from an exploding mine. The blast protecting material preferably comprises multiple layers of foam plastic or other energy absorbing materials having an overall thickness in the range 5 to 15 cm and preferably about 10 cm.

The ground engaging elements preferably comprise resilient members that can include chambers filled with compressible gas as in a bellows, or foamed plastic to permit some ground surface versatility. In some cases, rigid contact points may also be used, dependent on the terrain.

Overall it is desirable that the protection system is lightweight and not excessively cumbersome to use. The system preferably supports the foot of the operative at a height of at least 10 cm and preferably at least 15 cm, and most preferably at least 20 cm above the ground surface, this spacing together with the forward and rearward disposition of the ground engaging elements and the blast protecting material on the underside of the foot location combining to greatly reduce the likelihood of injury to the foot in the event that mine detonation is occasioned by the ground engaging elements, or otherwise occurs in the immediate vicinity of the feet of the operative.

BRIEF DESCRIPTION OF THE DRAWINGS

The invention will further be described, by way of example only, with reference to the embodiments shown in the accompanying drawings wherein.

DESCRIPTION OF THE PREFERRED EMBODIMENTS

Figure 1:
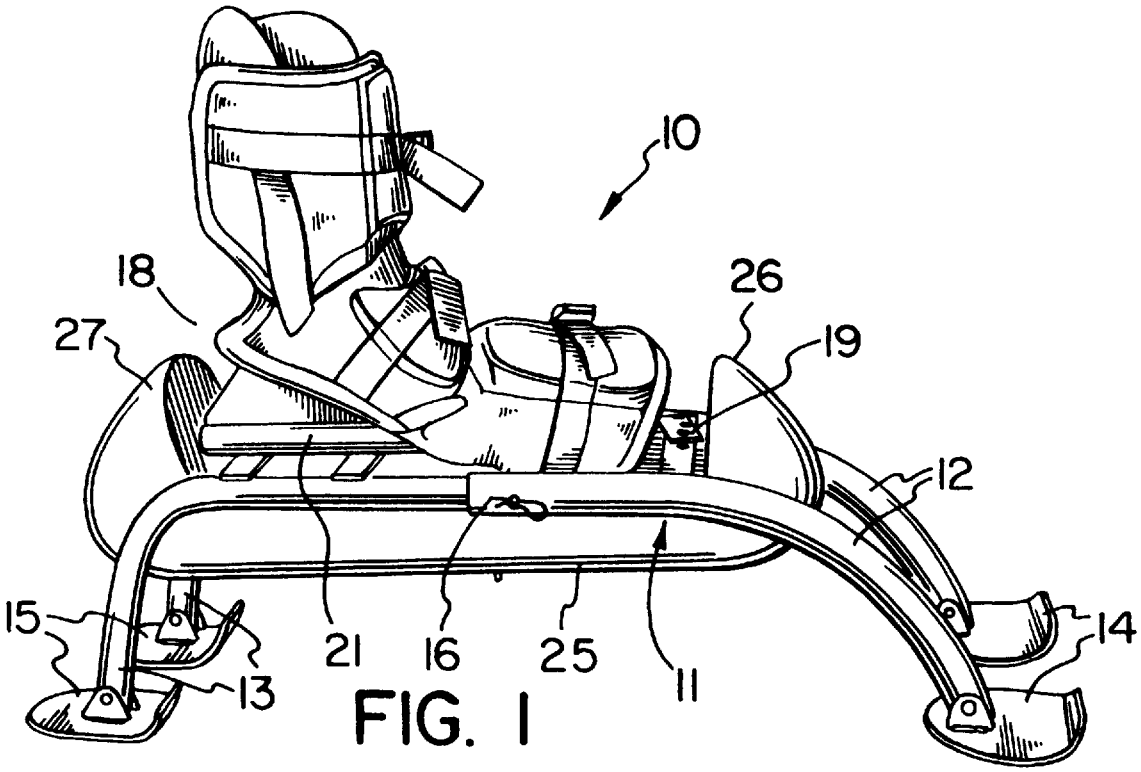
FIG. 1 is a perspective side view of a first embodiment of the foot protection system in accordance with the invention.

The foot protection system shown in FIG. 1 generally indicated at 10 comprises a framework 11 that is of inverted U-shape as seen in side view the framework comprising downwardly and forwardly curved front legs 12 and downwardly and rearwardly curved rear legs 13. The lower end of these legs carry ground-engaging elements in the form of flat pods 14, 15 respectively, which are upwardly curved at their forward ends and which can pivot through at least a limited angular range about horizontal axes to accommodate to irregularities in the ground surface upon which the system may be placed.

As indicated at 16, each side of the framework is telescopically adjustable so as to selectively change the longitudinal spacing between the front and rear pods 14, 15 within a limited range. The outboard edges of the rear pods are somewhat flattened and for ease of use, the overall width across the rear pods is less than that across the front pods by an amount of at least about 5 cm.

The framework 11 defines a foot location generally indicated at 18 which is designed to receive the foot of an operative and secure the protection system to the foot. In the embodiment of FIG. 1 the foot location is designed to receive a foot that is shod in a boot or the like, but obviously could be modified to include built-in footwear (not shown). The framework includes a front cross member 19 and a similar rear cross member (not shown) to provide structural rigidity. A foot receptor sub-frame 21 is attached to the front cross member 19,such attachment including a pivotal connection to allow the sub-frame 21 a limited range of pivotal movement about a generally horizontal transverse axis at its forward end.

The foot protection system shown in FIG. 1 is designed to receive the left foot of an operative, and therefore to provide a more natural foot attitude, the foot receptor is toed-out by a few degrees, e.g. between 5 and 10 degrees.

The underside of the foot location is shielded from the effects of a mine explosion by a shield 25 of lightweight blast absorbing material such as a lamination of Med/High density and lower density and/or polystyrene, polyethylene, polyurethane foams, having a thickness of 5 cm to 15 cm and densities in the range 10 to 130 kg/m$^3$. The shield 25 covers entirely the underside of the foot location providing continuous protection from side-to-side and from front-to-rear beneath the foot receptor 21. The shield has front and rear upwardly curved extensions 26, 27 which provide protection to the foot location in the case of mine detonations that occur to the front and to the rear thereof. Also the shield can be extended outwardly and upwardly at the sides (not shown) of the foot location to add further protection.

From the foregoing description and the accompanying drawings it will be appreciated that the foot protection system disposed in relation to FIG. 1 provides a high degree of protection to the foot of an operative. The fact that the front pods 14 and rear pods 15 are displaced longitudinally and do not lie immediately beneath the foot of the user, and that the foot location is displaced a substantial distance (i.e. at least 10 cm and as shown in FIG. 1 20 cm) above the supporting ground surface combine to greatly attenuate the blast force upon the user's foot of any mine that is initiated through pressure exerted by the supporting pods 14, 15.

The foot protection system 10 should be as compact and as lightweight as is consonant with sate operation by mine clearance personnel. It should not be excessively heavy or unwieldy since it could be worn by individuals for shifts of several hours. Also the system 10 should preferably not be fabricated from magnetisable material since such could interfere with operation of metal detector equipment that is commonly employed in mine clearance operations. In the embodiment of FIG. 1 the framework 11 is composed essentially of lightweight aluminum or aluminum alloy tubes or composite material structures, the pods 14 and 15 being of similar material, Referring now to FIGS. 2, 3 and 4, the foot protection system 100 shown in these views comprises a platform 101 that is supported generally horizontally upon a ground surface by four outwardly and downwardly curved legs comprising two front legs 102 and two rear legs 103, each leg carrying a ground engaging pod 104. As shown in FIG. 4A, the platform 101 has a horizontal area that can be much larger than the footprint 105 of a boot, the footprint shown in FIG. 4A representing a boot of overall length of about 32 cm. The dimensions of the foot platform should not greatly exceed the physical dimensions of a wearer's boot. In FIG. 4A, the platform was intended to accommodate a wide range of boot sizes.

The front part of the platform 101 is fixed and comprises a series of raised longitudinal upwardly projecting ribs 106, which are of uniform height and which support the toe portion of the boot about 2 cm above the top of the platform 101. The remainder of the boot is supported upon a pivotally mounted flat plate 107 which has a thickness corresponding to the height of the ribs 106 and which is pivoted at its forward end on a transverse pivot axis 108 formed by hinge brackets 110 carried on the platform 101 or through an elastic/plastic flat material forming a bridge that can pivot with the foot motion. The range of pivotal movement is restricted to a maximum amount as illustrated in FIG. 3 by a pair of hook plates 112 mounted on the platform and each providing an abutment for engaging the lateral edge of the pivot plate 107 to limit its upwards pivotal movement.

On the rear part of the plate 107 there is an upstanding forwardly open U-shaped heel stopper 114 that is formed integrally with the plate and that has in each of its opposite sides a large rectangular recess 116 to accommodate the corresponding hook plate 112 throughout the range of pivotal movement of the plate 107. The heel stopper 114 provides a mounting support for a binding structure by means of which the assembly can be secured to the boot 118 of a user, the binding comprising an adjustable instep strap 120 which spans the sides of the heel stopper 114 across the instep portion of the boot and has ends that are adjustably connected by suitable fasteners (not shown) at selected locations in the sides of the heel stopper 114 so that the binding can be adapted to accommodate boots of various sizes. The strap 120 is adjusted in length to snugly enclose the boot, and is secured by suitable means such as buckles or Velcro fasteners for example. An upper binding portion comprising a U-shaped ankle support 122 is adjustably pivotally attached at its sides to the top of the heel stopper 114 and also carries an adjustable strap 124 by means of which the apparatus can be snugly secured around the boot and the lower leg of the user. It will be understood that the ankle support 122 is pivotal relative to the heel stopper 114 to accommodate normal pivotal movement and adjustment of the lower leg with respect to the foot of the user.

Figure 2:
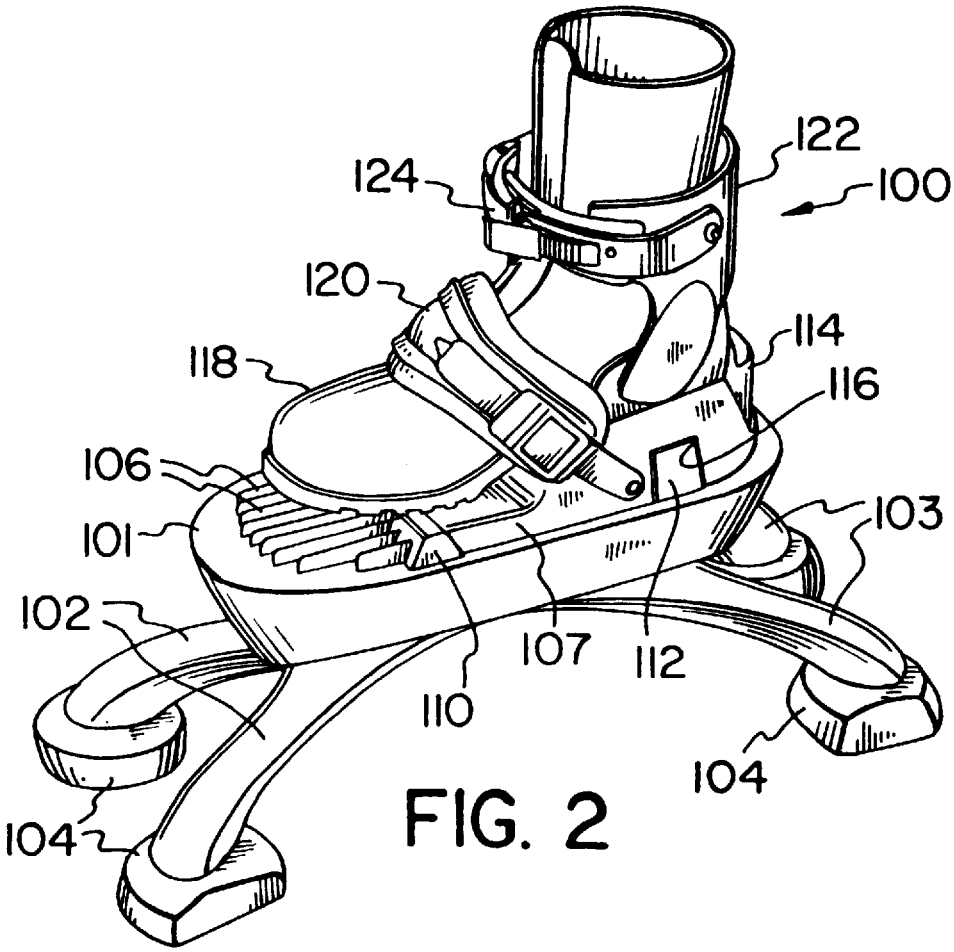
FIG. 2 is a perspective view of a presently preferred embodiment of the foot protection system in accordance with the invention, shown with a boot supported thereon.
Figure 3:
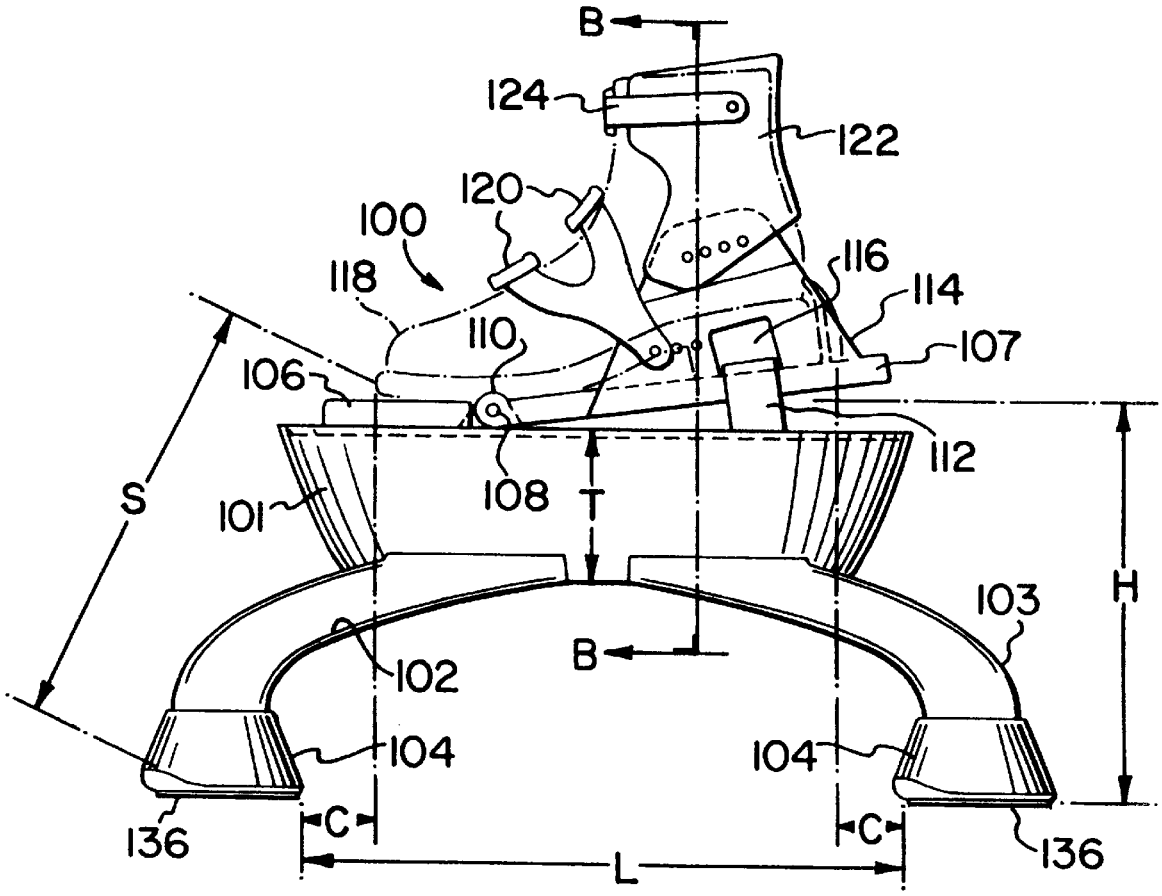
FIG. 3 is a side elevation of the embodiment shown in FIG. 2.
Figure 4A:
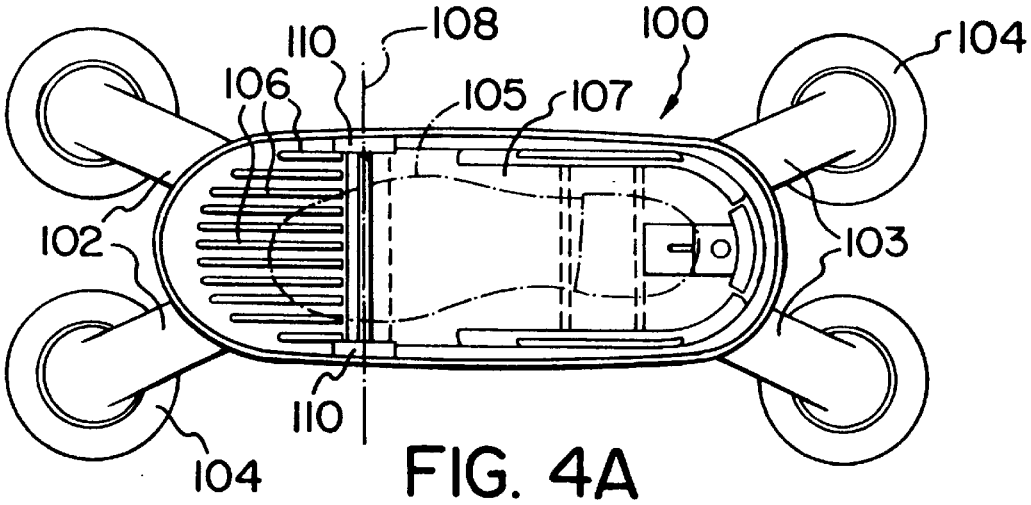
FIG. 4A is a plan view corresponding to FIG. 3.
Figure 4B:
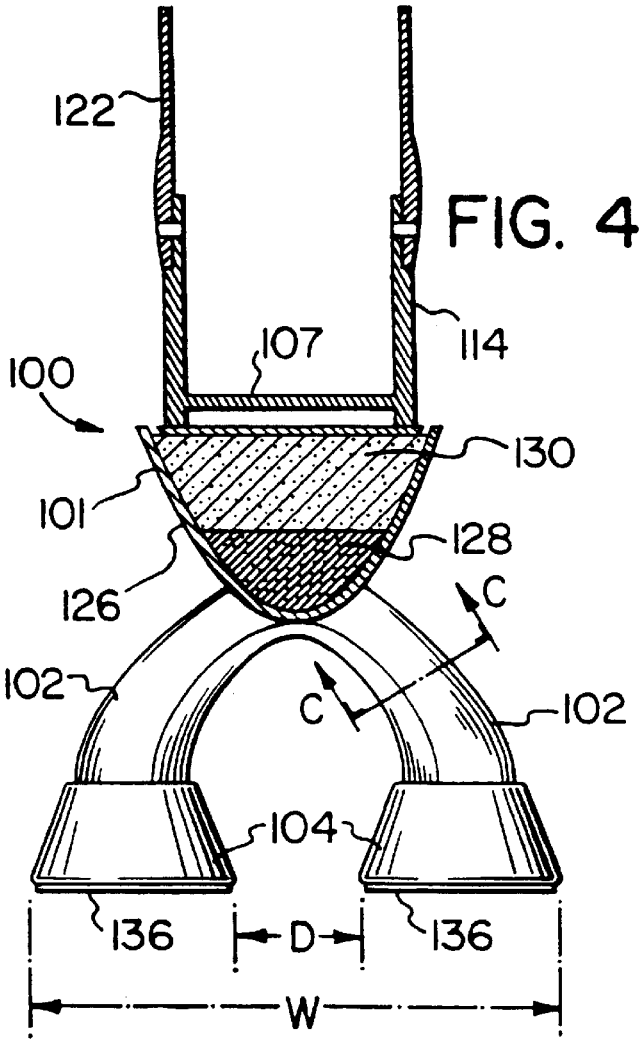
FIG. 4B is a sectional view taken on the line B—B of FIG. 3.

The platform 101 is of overall canoe shape as is best seen in FIGS. 2, 3 and 4B, having an overall length and width that are substantially greater than those of any boot that will be accommodated, the sides of the platform tapering convexly in the downwards direction as seen in the drawings to present a somewhat wedge-like aspect towards the ground, as seen particularly in FIG. 4B, this being important to provide a deflection laterally outwardly, or forwardly or rearwardly, of the pressure wave loading, as well as solid particles and fragments hurled upwardly e.g. by the explosion of a land mine under the foot protection apparatus.

The internal construction of the platform is shown in FIG. 4B, the platform comprising a molded composite material shell fabricated of e.g. glass fibre, aramid fibre or plastic enclosing a composite core of blast absorbing material comprising a lower core section 128 of low density foam plastic material and an upper core section 130 of a foam plastic material that is of much lower density than the lower section 128. Suitable materials of the core sections are:

lower section 128 polyethylene 65–130 kg/m$^3$ upper section 130 polyethylene based foam 25–45 kg/m$^3$ By judicious selection of the shape and material of the downwardly facing surfaces of the platform 101 and of the nature and density of the materials of the core sections 128, 130, the damaging effects of blast pressure loading and fragmentation pieces hurled upwardly by an exploding mine can be very much diminished so that the danger of injury to the feet or lower limbs of the user is correspondingly reduced. Moreover, the blast wave loading on the foot itself is attenuated by the energy absorbing foam type materials beneath the foot platform and the possibility of damping of any relative motion between foot and platform.

The shell of the platform 101 is fabricated, e.g. by molding from a suitable composite plastic or non-ferrous metal material, and the core sections 128, 130 can be molded within the shell 101.

Figure 4C:
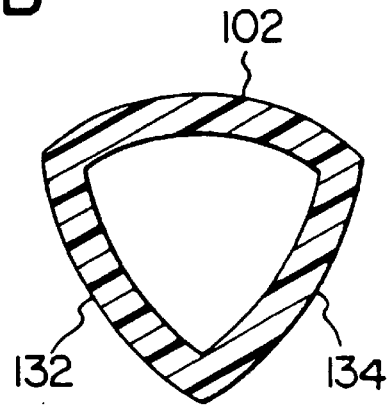
FIG. 4C is an enlarged sectional view taken on the line C—C in FIG. 4B.

The front legs 102 and the rear legs 103 are of similar construction each comprising an elongate curved member having an upper end that is substantially horizontal and is attached to the underside of the platform 101, the leg curving away from the platform and laterally outwardly and downwardly to terminate in the pod 104. As seen in FIG. 4C, each of the legs 102, 103 comprises a hollow molded plastics section of somewhat triangular outline having convex lower sides 132, 134 which offer a downwardly oriented wedge-like profile to maximize blast deflection. The pod 104 attached to the lower end of each leg 102, 103, is of soft construction and may be fabricated in a compressible light-weight foam plastic material, and has on its underside a tread piece 136 to provide improved traction between the pod and the ground surface. The pod itself can perform the function of a bellows, or serve as a rigid contact point with the ground. Some level of height adjustability is required for non-flat terrain.

The foot protection systems described herein counteract the effects of exploding mines upon the feet of operatives in two ways: the configuration of the platform 1 and the legs 102, 103 space the user's foot, represented by the boot 118, a substantial distance away from any mine that may be exploded by one of the pods 104, and the shape and construction of the legs 102, 103 and in particular of the lower side of the platform 101 help to deflect and/or to absorb the energy of the blast wave pressure and mine fragments. With reference to FIG. 3 the system supports the boot at a height H above the ground surface, and the pods 104 are spaced apart by a distance L in the longitudinal direction. The protective effects of the system are enhanced with increases in both of the dimensions H and L, but these dimensions cannot be made too large or else the system will become unwieldy and uncomfortable to the user. It will be understood that in mine clearance operations the user will have to wear the foot protection system for many hours, and will also have to be able to move about in more or less unrestricted manner across the ground surface that is being cleared. Thus as a practical matter it has been determined that the dimension H should be within the range 10 to 40 cm, and preferably about 20 cm, and the dimension L should be within the range 25 to 80 cm and preferably about 55 cm. Furthermore it is desirable for the pods 104 to be spaced longitudinally away from the foot location, such spacing being represented by the dimensions C in FIG. 3, C being in the range from 10 to 40 cm, preferably between 10 and 30 cm, and most preferably about 20 cm.

It will be appreciated that in terms of protective effect, the dimensions C and H are interrelated, and for the same protective effect, if the dimension C is increased, then the dimension H can be reduced and vice versa. Referring to FIG. 4B, the lateral spacing between the pods 104 is represented by the dimension D, and the overall lateral width of the system is represented by the dimension W. These dimensions also can be varied within relatively wide limits. The dimension W may be anywhere within the range 10 to 40 cm, but is preferably about 25 cm since for widths of 30 cm or more the system becomes a little unwieldy in requiring the user to maintain an uncomfortably large lateral spacing between the left foot and the right foot. The lateral extent W of the rearmost pair of pods 104 is preferably slightly less (e.g. up to 10 cm) than that between the forwardmost pair of pods 104, and the foot location may be correspondingly "toed-out" by up to 5 degrees, since this makes the system more comfortable for the user in that the user's feet can assume a more natural orientation.

The vertical thickness (T in FIG. 3) of the foam filled platform 101 can likewise be varied within wide limits, and may be anywhere from 5 to 15 cm, and preferably about 10 cm.

The combined effects of the dimensions C and H are to ensure that there is a substantial spacing, S in FIG. 3, between the pods and the closest adjacent part of the foot location, since this distance S and the deflection angle are critical factors in reducing injuries. It has been determined that the distance S should be not less than 10 cm, and for practical reasons no more than 40 cm, preferably in the range 20 to 30 cm and most preferably about 25 cm. Although not shown in FIG. 3, it will be understood that a similar spacing S should be provided between the rear pods 104 and the heel of the boot of the user.

The dimensions C and S will vary somewhat according to the size of the boot 118, and the dimensions and ranges discussed are established in relation to a size 12 boot (length 30 cm). The vast majority of users will have boot sizes less than 12, so that an additional margin of protection is available.

Figure 5:
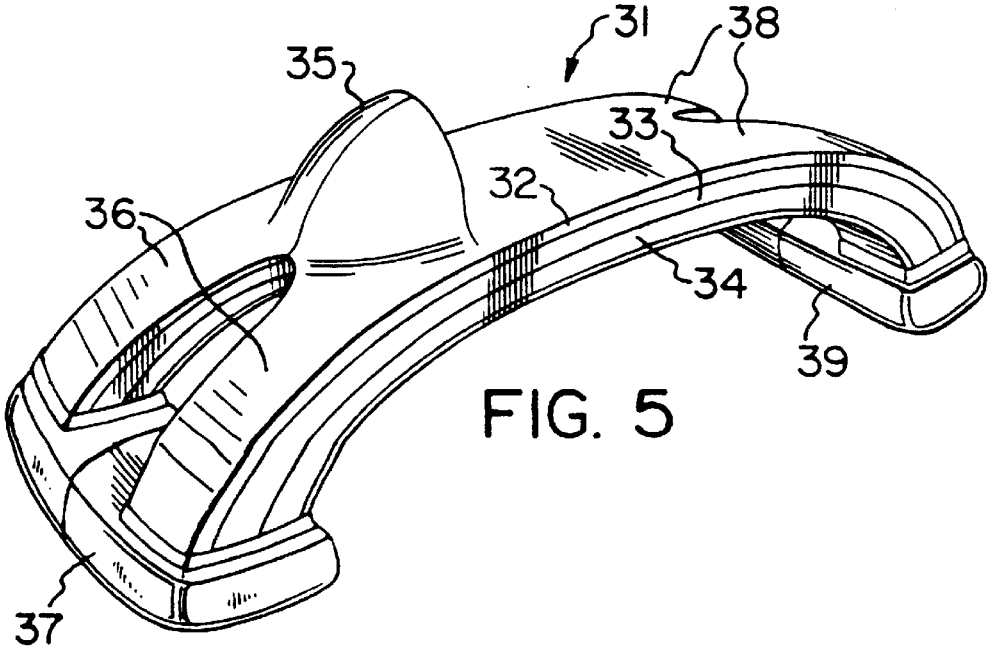
FIG. 5 is a perspective view of the frame portion of an alternative embodiment of the foot protection system.

Alternative embodiments of the framework are shown in FIGS. 5 through 9. Referring to FIG. 5 there is shown a framework 31 of a foot protection system which is equivalent in function to the framework 11 of FIG. 1. For clarity of illustration, the foot receptor sub-frame and related parts are omitted from these figures. However these parts may be similar in function to those described in relation to FIGS. 1 and 2 to 4.

The framework 31 is of lightweight composite construction comprising an upper layer 32 of polycarbonate or of composite materials (aramid, glass, polyethylene fibres) construction, at least one intermediate layer 33 (thickness 5 mm to 5 cm) of a rigid lightweight foam plastic material, and a lower layer 34 (thickness 5 mm to 15 mm) of blast protecting material. The composite layered material may be fabricated in flat sections which are subsequently cut to shape and bent into the arched configuration as shown in FIG. 5. The framework may include an integrally molded toe cap 35. Forwardly of the toe cap the framework divides into two curved limbs 36 which terminate in a transverse ground-engaging pad assembly 37. At the rear of the framework 31 there are two laterally spaced downwardly curved limbs 38 which terminate in a rear ground-engaging pad assembly 39. The pad assemblies 37, 39 have a generally rectangular footprint extending transverse to the length of the frame, and are fabricated to be of compliantly compressible structure. For this purpose the pad assemblies may constitute gas filled structures, or compressible foam.

It will be appreciated that the limbs 36 and 38 are of resiliently flexible composition, and this combined with the inherent compressibility of the pad (or foam) assemblies 37, 39 ensures that the framework 31 can readily accommodate itself to irregularities in the ground surface upon which it is supported.

Figure 6A:
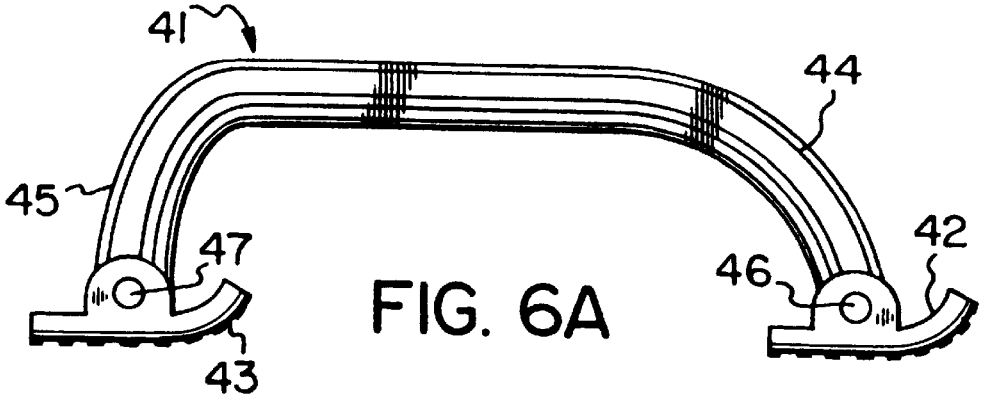
FIG. 6A is a side view of the frame portion of a third alternative frame portion of the protection system, FIG. 6B being a fragmentary view of a foot portion of the frame, and FIG. 6C being an enlarged sectional view of a foot portion of the frame.
Figure 6B:
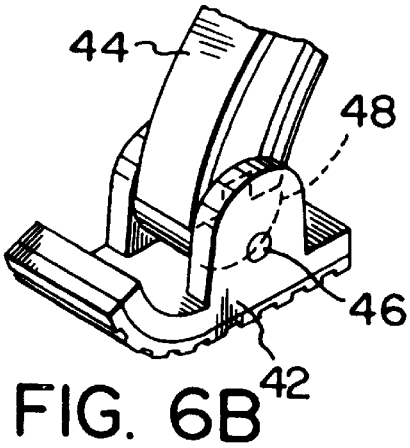
Figure 6C:
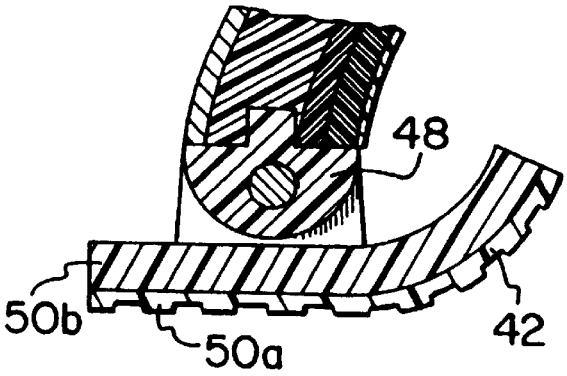

Referring to FIGS. 6A, 6B and 6C, the framework 41 shown here is similar in construction and configuration to that shown in FIGS. 2 to 5 and will not be described further. In FIGS. 6A to 6B, the ground-engaging elements are formed by generally rectangular feet 42, 43 which are pivotally attached to the lower ends of the forward and rearward limbs 44, 45 respectively by pivot pins 46, 47 respectively received in rounded end pieces 48, carried at the lower ends of the limbs 44, 45. The feet 44, 45 have upwardly curved front ends and comprise a thin profiled traction pad 50*a* over a lightweight plastic backing piece 50*b*.

Figure 7A:
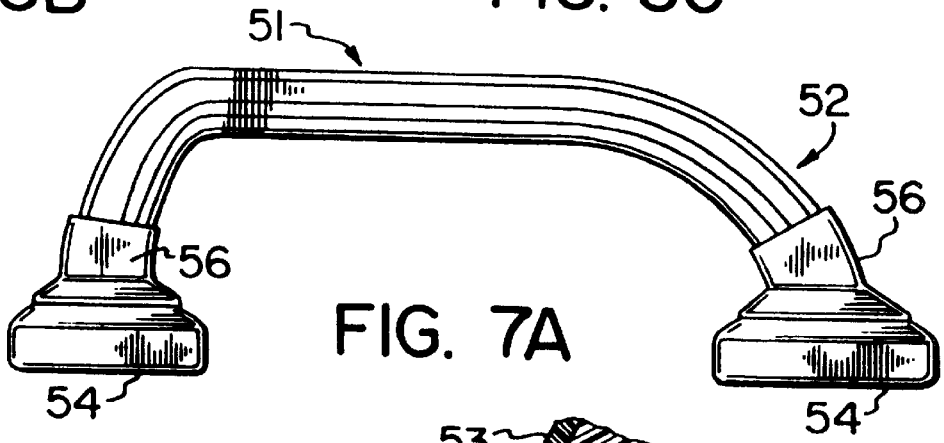
FIGS. 7A, 7B and 7C are views corresponding to 6A, 6B and 6C showing a fourth embodiment of the frame.
Figure 7B:
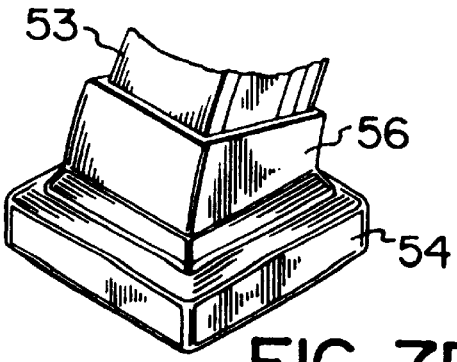
Figure 7C:
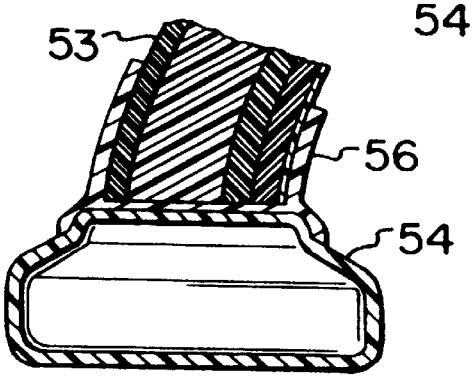

Referring to FIGS. 7A, 7B and 7C there is shown a foot protection system framework 51 which is similar in construction and configuration to those discussed above in relation to FIGS. 5 and 6. At the lower end of each of the legs 52, 53 is a pad assembly in the form of a somewhat rectangular air filled compartment 54, or readily compressible pod, e.g. of foam, attached to the lower end of the associated leg by an adhered backing piece 56 which is bonded to the top of the pod (air bag) 54 and to the corresponding leg 52, 53.

Figure 8A:
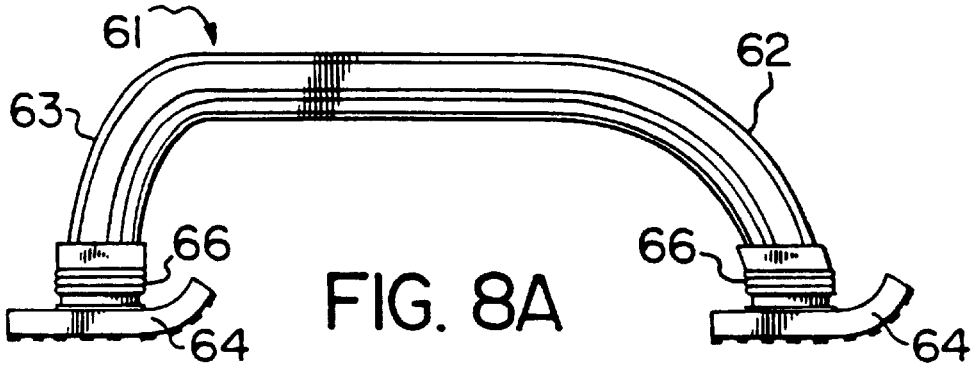
FIGS. 8A, 8B and 8C are views corresponding to 6A, 6B and 6C showing a fifth embodiment.
Figure 8B:
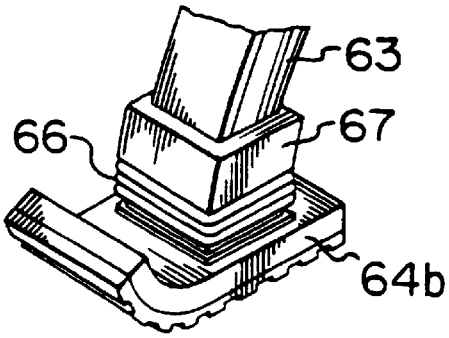
Figure 8C:
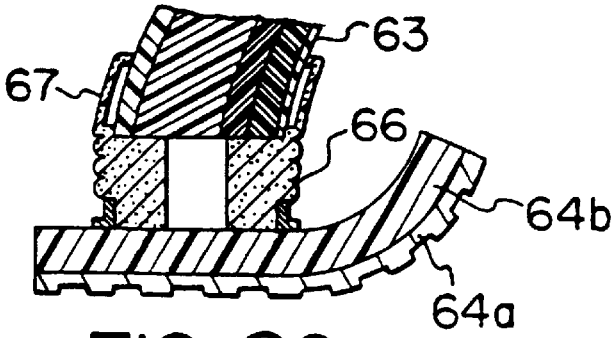

The framework 61 shown in FIG. 8A is of similar shape and construction to that shown in FIGS. 5, 6A and 7A, defining spaced pairs of front legs 62 and rear legs 63. The ground-engaging feet 64 in FIGS. 8A to 8C are similar in construction to those of FIGS. 6A to 6C comprising traction pads 64*a* adhered to lightweight plastic backing pieces 64*b*. On the upper side of each of the feet 64 there is a tubular deformable bellows 66 forming a connection with the lower end of the leg 62, 63 through a suitable connecting layer 67. The backing piece of each foot 64 is preferably of high density foam material, the bellows being of elastic configuration and therefore capable of a large range of pivotal deformation about any horizontal axis.

Figure 9:
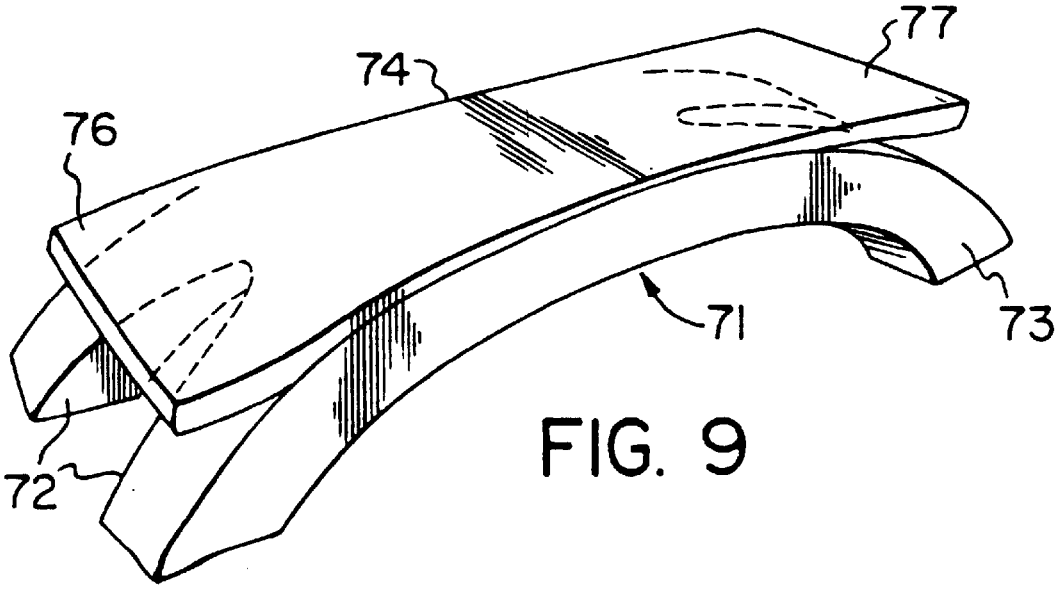
FIG. 9 is a view corresponding to FIG. 5 showing a fifth embodiment.

The framework 71 shown in FIG. 9 is generally similar in shape and construction to the examples of FIGS. 5, 6A, 7A and 8A and may include any of the arrangements of traction pads, air chambers, bellows and the like as disclosed therein. The FIG. 9 embodiment however is further characterized by the provision of a rectangular platform 74 which is attached to the framework 71 and projects horizontally over the front and rear legs 72, 73. The platform 74 can be made integral with the central part of the framework, and may incorporate a limited degree of resilience, the ends 760, 77 being spaced above the corresponding lower ends of the front and rear legs 72, 73. The platform thus provides added protection in the event that the legs 72, 73 are broken off by an exploding mine. In this event the front and rear platform ends 76, 77 will act to prevent broken fragments being projected directly upwardly towards the operative, but rather will deflect them outwardly away from the operative the platform, although being structurally much lighter than the legs is nonetheless likely to be effective for the intended purpose by virtue of the fact that it is of resilient construction and is at a greater spacing above the ground surface than are the legs. Suitable materials for the platform are composite materials similar to those used for the shell in FIGS. 2–6 (e.g. comprised of aramid, glass or plastic fibres).

Although some presently preferred exemplary embodiments are described in the foregoing in relation to the drawings, it will be understood that the invention is capable of modification in its details, and therefore encompasses all embodiments falling within the ambit of the appended claims.

We claim:

1. A protection system to protect the foot of a user against anti-personnel mines, said system comprising:

a frame configured to receive and be attached to a user's footwear to support the foot in a location that is at a height of at least 10 cm above a supporting ground surface;

said frame carrying ground-engaging elements that have overall extents in longitudinal and lateral directions that are sufficient to provide stable support for said frame on the supporting ground surface;

said ground-engaging elements being discrete and spaced apart, and said frame having an underside that is spaced upwardly in relation to said ground-engaging elements so as to have clearance above the supporting ground surface;

at least parts of said system being compliantly deformable to accommodate irregularities in the supporting ground surface.

2. A protective system as claimed in claim 1 further including blast protecting material completely covering the underside of said foot location.

3. A protective system as claimed in claim 1 wherein the underside of the structure is aerodynamically shaped to deflect blast wave loading and fragments.

4. A protection system as claimed in claim 1 wherein a forwardmost of said ground-engaging elements is located forwardly of said foot location.

5. A protection system as claimed in claim 1 wherein a rearwardmost of said ground-engaging elements is positioned rearwardly of said foot location.

6. A protection system as claimed in claim 1 wherein said ground-engaging elements comprise of at least pairs of laterally spaced pods, or a single wider element serving as a pod.

7. A protection system as claimed in claim 1 wherein said foot location is defined by a receptor that is movable to accommodate pivotal movement about a transverse axis at a forward part of said receptor.

8. A protection system as claimed in claim 7 wherein said receptor furthermore includes a binding structure configured to engage around the foot and ankle of the user.

9. A protection system as claimed in claim 1 wherein said frame is fabricated from a lightweight composite, plastic or metal material.

10. A protection system as claimed in claim 9 wherein said lightweight metal comprises a non-ferrous metal or metal alloy.

11. A protection system as claimed in claim 1 wherein said frame is of composite construction comprising an upper layer of tough composite or plastics material, a lower layer of blast absorbing material and at least one inner layer of lightweight foamed plastic or composite material.

12. A protection system as claimed in claim 1 wherein said ground-engaging elements comprise in part lightweight foamed plastic material.

13. A protection system as claimed in claim 1 wherein said frame is configured to support the user's foot at a height of at least about 15 cm above the ground surface.

14. A protection system as claimed in claim 1 wherein said frame is configured to support the user's foot at a height of between 15 and 30 cm above the ground surface.

15. A protection system as claimed in claim 1 having dimensions within the following ranges:

a) overall length between 30 and 80 cm;

b) width of between 10 and 40 cm;

c) distance between front of foot location and a forward ground-engaging element in the range from 10 cm to 40 cm;

d) a distance from the rear of the foot location to the rearmost ground engaging element of between 10 and 25 cm.

16. A protection system as claimed in claim 15 wherein the distance between the front of the foot location and a forward ground-engaging element is between 15 and 30 cm; the distance between the rear of the foot location and rearward ground-engaging element is between 15 and 30 cm and wherein the overall width of the protection system at the location of the rear ground-engaging elements is somewhat less than the overall width at the location of the forward ground-engaging elements.

17. A protection system to protect the foot of a user against anti-personnel mines, said system comprising:

a frame configured to receive and be attached to a user's footwear to support the foot in location that is at a height of at least about 10 cm above a supporting ground surface;

said frame carrying ground-engaging elements that have overall extents in the longitudinal and lateral directions that are sufficient to provide stable support for said frame on the supporting ground surface;

said frame being of arch-shaped configuration and being bifurcate at its front and rear ends to define pairs of laterally spaced legs having lower ends which carry said ground-engaging elements;

at least parts of said system being compliantly deformable to accommodate irregularities in the supporting ground surface.

18. A protection system as claimed in claim 17 including blast protecting material completely covering the underside of said foot location, the underside of said frame beneath said foot location being spaced above the supporting ground surface and being aerodynamically shaped to deflect blast wave loading and fragments.

19. A protection system as claimed in claim 17 wherein said ground-engaging elements are spaced forwardly and rearwardly of said foot location, and between said ground engaging elements the underside of said frame being spaced above the supporting ground surface.

20. A protection system as claimed in claim 19 wherein said ground-engaging elements comprise at least one pair of laterally spaced pods.

21. A protection system to protect the foot of a user against anti-personnel mines, said system comprising:

a frame configured to receive and be attached to a user's footwear to support the foot in a location that is at a height of at least about 10 cm above a ground surface;

said frame carrying ground-engaging elements that have overall extents in longitudinal and lateral directions that are sufficient to provide stable support for said frame on a supporting ground surface;

wherein there are at least two said ground-engaging elements arranged at a longitudinal spacing which is not less than the length of said foot location;

at least parts of said system being compliantly deformable to accommodate irregularities in the supporting ground surface.

22. A protection system as claimed in claim 21 including blast protection material completely covering the underside of said foot location, the underside of said frame being spaced above said supporting ground surface.

23. A protection system as claimed in claim 22 wherein said ground-engaging elements are spaced forwardly and rearwardly of said foot location, there being no ground-engaging element directly beneath said foot location.

24. A protection system as claimed in claim 21 wherein the underside of said structure is aerodynamically shaped to deflect blast wave loading and fragments.

25. A protection system as claimed in claim 22 wherein said ground-engaging elements include at least one pair of laterally spaced pods.

* * * * *

UNITED STATES PATENT AND TRADEMARK OFFICE

CERTIFICATE OF CORRECTION

PATENT NO. : 6,006,646

DATED : 12/28/99

INVENTOR(S) : MAKRIS ET AL

It is certified that error appears in the above-identified patent and that said Letters Patent is hereby corrected as shown below:

Column 5, lines 37 and 56: after "shell" insert --126--.

Column 5, line 59: delete "101", insert --126--.

Column 6, line 13: delete "1", insert --101--.

Column 8, line 23: delete "760", insert --76--.

Column 8, line 29: amend "the platform" to read --. The platform--.

Signed and Sealed this

Twenty-first Day of November, 2000

*Attest:*

Q. TODD DICKINSON

*Attesting Officer*

*Director of Patents and Trademarks*